US010569597B2

(12) United States Patent
Yang

(10) Patent No.: US 10,569,597 B2
(45) Date of Patent: Feb. 25, 2020

(54) PEN STRUCTURE WITH GLASS SMASHER

(71) Applicant: Chun-Kai Yang, Taipei (TW)

(72) Inventor: Chun-Kai Yang, Taipei (TW)

( * ) Notice: Subject to any disclaimer, the term of this patent is extended or adjusted under 35 U.S.C. 154(b) by 22 days.

(21) Appl. No.: 15/942,616

(22) Filed: Apr. 2, 2018

(65) Prior Publication Data

US 2019/0061413 A1 Feb. 28, 2019

(30) Foreign Application Priority Data

Aug. 24, 2017 (TW) ..... 106128790 A

(51) Int. Cl.

| | |
|---|---|
| ***B43K 29/00*** | (2006.01) |
| ***B43K 29/18*** | (2006.01) |
| ***A62B 3/00*** | (2006.01) |
| ***B43K 25/02*** | (2006.01) |
| ***B43K 7/12*** | (2006.01) |
| ***B43K 24/06*** | (2006.01) |
| ***B43K 7/00*** | (2006.01) |

(52) U.S. Cl.

CPC ..... *B43K 29/18* (2013.01); *A62B 3/005* (2013.01); *B43K 7/005* (2013.01); *B43K 7/12* (2013.01); *B43K 24/06* (2013.01); *B43K 25/022* (2013.01)

(58) Field of Classification Search

CPC ..... B43K 29/18; B43K 24/06; B43K 7/12; A62B 3/005

USPC ..... 401/195

See application file for complete search history.

(56) References Cited

U.S. PATENT DOCUMENTS

| | | | | |
|---|---|---|---|---|
| 6,640,450 | B2 * | 11/2003 | Teague | B43K 29/18 30/123 |
| 9,108,454 | B1 * | 8/2015 | Rosenberg | B43K 29/00 |
| 9,428,002 | B2 * | 8/2016 | Rosenberg | B43K 29/00 |
| 2018/0066915 | A1 * | 3/2018 | Cheng | F41B 15/06 |
| 2018/0361178 | A1 * | 12/2018 | Cheng | A62B 3/005 |

* cited by examiner

*Primary Examiner* — Jennifer C Chiang

(74) *Attorney, Agent, or Firm* — Jung Chun Hung

(57) ABSTRACT

A pen structure with a glass smasher has the glass smasher mounted at the front end of a pen. When a user holds the pen and presses the front end (i.e., the smashing cone) of the smashing rod of the glass smasher forcibly against a glass obstacle, an impact block will strike the rear section of the smashing rod vigorously such that the smashing cone is instantly driven to smash the glass obstacle. A ballpoint/rollerball refill is detachably provided in the pen and is at least 6 cm long in order to contain enough ink. The overall length of the pen is at least 10 cm so that the pen can be easily held while the user writes or draws with the ballpoint/rollerball tip and while the user applies a force to a glass obstacle through the front end of the smashing rod to smash the glass obstacle.

19 Claims, 13 Drawing Sheets

PEN STRUCTURE WITH GLASS SMASHER

FIELD OF THE INVENTION

The present invention relates to a pen structure and more particularly to one equipped with a glass smasher, wherein the overall length of the pen not only provides portability, allowing the pen to be used as a writing instrument at normal times, e.g., to write or draw with the ballpoint/rollerball tip of the pen, but also makes the pen readily accessible in an emergency or disastrous situation involving a glass obstacle, allowing the user to hold the pen body with ease and apply a force at a specific point on the glass obstacle through the exposed front end of the smashing rod of the glass smasher, in order to smash the glass obstacle immediately and thereby dissolve the emergency or disastrous situation.

BACKGROUND OF THE INVENTION

Thanks to technological advancements, the development of glass materials has reached a highly mature state, giving rise to various types of glass that have different physical properties and applications, such as safety glass, tempered glass, thermally stable glass, low-expansion glass, and laminated glass, to name only a few. These new types of glass have enhanced the quality of our daily lives but also form blind spots in terms of safety. For instance, doors and windows (including car windows) made of tempered glass, which cannot be rapidly smashed without a proper tool, tend to hinder escape from a house, car, or other glass-enclosed environment where an accident (e.g., a fire or car crash) takes place. In addition, the sharp broken pieces of such tempered-glass obstacles are hard to remove and may therefore delay escape or rescue, leading to tragic consequences.

Take tempered glass and safety glass, which have high structural strength and are widely used nowadays in public transportation (e.g., busses and streetcars) and buildings, for example. Such a glass material is so difficult to smash that a police officer, firefighter, or rescue team member striking it with a hammer, bat, or other heavy object may be injured by the massive recoil of the striking tool in use. Generally speaking, only by hitting the glass material perpendicularly and vigorously with a pointed heavy object can the cohesive force in the glass material be effectively reduced to such extent that the glass material eventually breaks. Currently, referring to FIG. 1, the market is supplied with a portable tool 11 (e.g., a baton or flashlight) for use by the police and the fire departments to smash glass obstacles, wherein the tool 11 is mounted with a smashing cone 10. When a police officer or firefighter carrying out an emergency rescue operation or raid encounters an obstacle 12 made of strong glass (e.g., the windscreen or a window of a car), he or she can take out the tool 11 immediately and hit the glass obstacle 12 with the smashing cone 10 in order to reduce the cohesive force within the glass obstacle 12, thereby forming a breaking point in, and consequently shattering, the glass obstacle 12 to facilitate the rescue or attack.

In use, however, the tool 11 leaves plenty of room for improvement. One major drawback lies in the fact that the smashing cone 10 is typically fixed at one end (e.g., the front or rear end) of the tool 11 in order to be portable along with the tool 11, and that therefore one who uses the tool 11 in an emergency rescue operation or raid must hold the tool 11 with the thumb facing themselves (see FIG. 1) in order to apply a force to the smashing cone 10 and hit the glass obstacle 12 repeatedly. Nevertheless, the way the tool 11 is held makes it difficult not only for the user to exert a force on the smashing cone 10, but also for the user to strike precisely the same spot on the glass obstacle 12 while moving the smashing cone 10 back and forth. As a result, the cohesive force within the glass obstacle 12 may stay intact even though the user has made great physical efforts, and failure to smash the glass obstacle 12 in time may bring about failure of the intended rescue or attack.

To overcome the foregoing drawbacks (i.e., the bulkiness and hence unsatisfactory portability of the tool 11, and the difficulty of hitting precisely the same spot on the glass obstacle 12 with the smashing cone 10), a novel expandable baton 2 as shown in FIG. 2 was developed. The expandable baton 2 is compact in size, can be easily carried around by a police officer or firefighter for self-defense, and can be expanded whenever needed in an emergency rescue or attack. Simply by holding the handle of the expandable baton 2, a user can apply a force to precisely the same spot on a robust glass obstacle over and over again through the smasher 4 at the front end of the expandable baton 2, in order for the smasher 4 to build up a striking force large enough to dissolve the cohesive force in the glass obstacle. As shown in FIG. 2, the expandable baton 2 includes an outer shaft 21 and at least one inner shaft 22. The outer shaft 21 and the inner shaft 22 form the basic structure of the expandable baton 2. The rear section of the outer shaft 21 forms a handle to be gripped by a user. The outer diameter of the inner shaft 22 is smaller than the inner diameter of the outer shaft 21 so that the inner shaft 22 can be moved, and thus mounted, into the outer shaft 21 through the rear end of the outer shaft 21. In addition, the configuration of the rear end portion 22*a* of the inner shaft 22 matches the configuration of a portion of the outer shaft 21 that is adjacent to the front end portion 21*a* of the outer shaft 21. For example, the rear end portion 22*a* of the inner shaft 22 flares a little while the front end portion 21*a* of the outer shaft 21 converges slightly to enable engagement between the two end portions. When the inner shaft 22 is displaced outward of the front end portion 21*a* of the outer shaft 21 such that the rear end portion 22*a* of the inner shaft 22 reaches a position in the outer shaft 21 that is adjacent to the front end portion 21*a* of the outer shaft 21, the outer wall of the rear end portion 22*a* of the inner shaft 22 is engaged with an inner wall portion of the outer shaft 21 that is adjacent to the front end portion 21*a* of the outer shaft 21. As a result, the entire inner shaft 22 is exposed from the front end portion 21*a* of the outer shaft 21 except for the portion adjacent to the rear end portion 22*a* of the inner shaft 22, which portion is now secured in the outer shaft 21. Conversely, when the inner shaft 22 is stored in the outer shaft 21, the rear end portion 22*a* of the inner shaft 22 is secured by an engaging member 21*b* in the rear end of the outer shaft 21, leaving only the front end of the inner shaft 22 exposed from the front end portion 21*a* of the outer shaft 21.

Referring to FIG. 3A in conjunction with FIG. 2, the smasher 4 is provided at the front end of the inner shaft 22 (or the front end of the innermost inner shaft 22 if the expandable baton 2 has several inner shafts 22) and includes a base 40, an eccentric spring 413, an impact block 43, a compression spring 44, and a smashing rod 45. The base 40 is coupled to the front end of the inner shaft 22 such that the base 40 and the inner shaft 22 form a single unit. An impact groove 41, a tapering groove 411, an aligning groove 412, and a compression force application groove 42 are sequentially formed, in a front-to-rear direction, in the base 40 and the front end of the inner shaft 22 and are in communication with one another. The front end of the base 40 is formed with an aperture 410. The aperture 410 is in communication sequentially with the impact groove 41, the tapering groove 411, the aligning groove 412, and the compression force application groove 42 and has a smaller diameter than the impact groove 41. The tapering groove 411 extends taperingly from the rear end of the impact groove 41 to the front end of the aligning groove 412, and the wall of the tapering groove 411 forms a first tapering pressing surface 4110. The diameter of the aligning groove 412 is smaller than those of the impact groove 41 and of the compression force application groove 42.

As shown in FIG. 3A, the impact block 43 is movably positioned in the compression force application groove 42. The front end of the impact block 43 can be pressed against the wall of the compression force application groove 42 (e.g., a portion of the compression force application groove 42 that is adjacent to the aligning groove 412) and is concavely provided with a striking groove 430. The striking groove 430 corresponds to the aligning groove 412 and has a smaller diameter than the aligning groove 412. The compression spring 44 is positioned in the compression force application groove 42 and has its two ends pressed respectively against the rear end of the impact block 43 and a wall portion of the compression force application groove 42 that is away from the aligning groove 412, in order to push the impact block 43 toward the aligning groove 412. To facilitate description of the structural features and striking principle of the smashing rod 45, the smashing rod 45 is hereinafter divided into a front section 450, a middle section 451, and a rear section 452. The front section 450 of the smashing rod 45 is formed with a smashing cone 4501. The middle section 451 matches the aligning groove 412 in diameter, and a wall portion of the middle section 451 that is adjacent to the rear section 452 forms a second tapering pressing surface 453. Normally, the axis of the smashing rod 45 is offset from the axis of the impact block 43 such that the rear end of the rear section 452 of the smashing rod 45 is pressed against the front end of the impact block 43 to prevent the rear section 452 of the smashing rod 45 from extending into the striking groove 430. Thus, with the front end of the impact block 43 pushing back at the rear end of the rear section 452 of the smashing rod 45, the smashing rod 45 is positioned in the impact groove 41, the tapering groove 411, and the aligning groove 412, with the smashing cone 4501 exposed from the front end of the smasher 4 through the aperture 410.

With continued reference to FIG. 3A, the eccentric spring 413 is mounted around the periphery of the middle section 451 of the smashing rod 45 and is positioned in the impact groove 41 and the tapering groove 411. The eccentric spring 413 has its two ends pressed respectively against a portion of the smashing rod 45 that is adjacent to the front section 450 and the wall of the tapering groove 411 (i.e., the first tapering pressing surface 4110), in order to push the front section 450 of the smashing rod 45 outward of the aperture 410, thereby exposing the smashing cone 4501 of the front section 450 of the smashing rod 45 from the front end of the smasher 4. The elastic force of the eccentric spring 413 must be smaller than that of the compression spring 44 so that, as soon as the rear section 452 of the smashing rod 45 is in alignment with the striking groove 430 (see FIG. 3B), the impact block 43 will strike the rear end of the rear section 452 of the smashing rod 45 under the action of the compression spring 44, and when the smashing cone 4501 of the front section 450 of the smashing rod 45 completes the intended striking and smashing action, the eccentric spring 413 will render the axis of the smashing rod 45 offset from the axis of the impact block 43, thereby moving the rear end of the rear section 452 of the smashing rod 45 away from the striking groove 430 and back to the position shown in FIG. 3A, i.e., pressed against the front end of the impact block 43 to wait for the next striking and smashing action to be performed.

Referring to FIGS. 3A and 3B in conjunction with FIG. 2, when a user holding the expandable baton 2 presses the smashing cone 4501 forcibly against a glass obstacle (e.g., a piece of tempered glass), the smashing rod 45 is gradually displaced toward the compression force application groove 42. When the second tapering pressing surface 453 of the wall of the middle section 451 of the smashing rod 45 is pressed against the first tapering pressing surface 4110, the middle section 451 of the smashing rod 45 begins to be guided by the aligning groove 412 into alignment with the axis of the impact block 43. Now that the middle section 451 of the smashing rod 45 matches the aligning groove 412 in diameter, the instant at which the middle section 451 becomes perfectly aligned with the striking groove 430 (i.e., enters the state shown in FIG. 3B), the rear section 452 of the smashing rod 45 thrusts into the striking groove 430, allowing the huge elastic force stored in the compression spring 44 to push the impact block 43 outward. The impact block 43 will in turn strike the rear end of the smashing rod 45, thereby driving the smashing cone 4501 at the front end of the smashing rod 45 to smash the glass obstacle vigorously. Thus, by equipping the expandable baton 2 with the smasher 4, the functions and applications of the expandable baton 2 are increased.

However, the overall length of the expandable baton 2 in the collapsed state (generally 20 cm or so) makes it difficult to put and store, let alone carry, the expandable baton 2 in a pocket of a user's upper-body garment or trousers in order to use the expandable baton 2 whenever needed. In addition, the pointed structure of the smashing cone 4501 of the front section 450 of the smashing rod 45 must be covered because the elastic forces applied to the smashing rod 45 by the eccentric spring 413 and by the compression spring 44 will keep the smashing cone 4501 exposed from the front end of the smasher 4. If the smashing cone 4501 is left uncovered, one who carries or is using the expandable baton 2 is very likely to be punctured or scratched by the smashing cone 4501, or injure people nearby, or cause damage to neighboring objects.

The issue to be addressed by the present invention, therefore, is to design a novel pen structure having a glass smasher. It is desirable that the structure of a glass smasher is applied to one end of a pen in a way that ensures structural compactness, so a police officer or firefighter not only can carry the assembly with them safely for the purpose of writing or drawing, but also can take the assembly swiftly out of a pocket for use during an emergency rescue operation or raid. It is also desirable that the smashing cone of the front section of a smashing rod in the glass smasher can be rapidly exposed from the end of the pen by the user removing a smashing cone cover from the front end of the glass smasher, and that the user can then control the assembly with ease while holding the pen body. More specifically, the user can hit the same spot on a robust glass obstacle repeatedly with the smashing cone in order to build up a striking force large enough to reduce the cohesive force in the glass obstacle, thereby breaking the glass obstacle effectively.

BRIEF SUMMARY OF THE INVENTION

In view of the various deficiencies and problems associated with the use of the foregoing conventional tools designed for the police and the fire departments, the inventor of the present invention conducted extensive research and repeated tests and finally succeeded in developing a pen structure with a glass smasher as disclosed herein. The present invention is intended to provide the glass smasher with enhanced safety while it is being carried around and make the glass smasher readily accessible when needed, thereby solving all the aforementioned drawbacks of the prior art and greatly increasing the speed, efficiency, and success rate of any rescue operation or attack where the glass smasher is applicable.

One objective of the present invention is to provide a pen structure having a glass smasher. The glass smasher is applied to a pen, is mounted at one end (e.g., the front or rear end, the upper or lower end, or the top or bottom end, hereinafter referred to as the first end) of the pen, and includes a smashing rod, an eccentric spring, an impact block, and a compression spring. The pen has a pen body, whose outer periphery is circumferentially and concavely provided with an engaging groove or threaded connection groove adjacent to the front end of the pen body. An impact groove, a tapering groove, an aligning groove, and a compression force application groove are sequentially provided, in a front-to-rear direction, in the pen body. The impact block is provided in the compression force application groove and is pushed toward the impact groove by the compression spring so as to position the smashing rod in the impact groove, the aligning groove, and the tapering groove, allowing the smashing cone of the front section of the smashing rod to be exposed from the front end of the pen body. When a user holds the pen body and presses the front end of the smashing cone forcibly against a glass obstacle, the middle section of the smashing rod is pressed against the wall of the tapering groove and is thus gradually guided into alignment with the axis of the impact block, in order for the rear section of the smashing rod to extend into a striking groove concavely provided at the front end of the impact block, and for the huge elastic force stored in the compression spring to push the impact block outward. The impact block will in turn strike the smashing rod, thereby driving the smashing cone to smash the glass obstacle instantly. The pen body is also provided therein with a ballpoint/rollerball refill, which can be detached from the pen body and has a ballpoint/rollerball tip and an ink tube. The ballpoint/rollerball tip is exposed from the opposite end (hereinafter referred to as the second end) of the pen. The ink tube extends into the pen body and is positioned in a central portion of the compression spring to make effective use of the unused space in the glass smasher and thereby achieve the following two goals: first, the length of the ballpoint/rollerball refill (i.e., the combined length of the ink tube and the ballpoint/rollerball tip) should be at least 6 cm in order for the ink tube to contain enough ink for use in writing or drawing for a long time; second, the overall length of the pen should be at least 10 cm so that a user can hold the pen without difficulty in order to write or draw with the ballpoint/rollerball tip or to break a glass obstacle by applying a force to it through the front end of the smashing rod.

Another objective of the present invention is to further provide the pen structure with a pen tip cover and a smashing cone cover. The pen tip cover is closed at one end and is provided with a first mounting opening at the opposite end (hereinafter referred to as the second end of the pen tip cover). The configuration and size of the first mounting opening are such that the second end of the pen tip cover can be mounted snugly around (e.g., engaged with or threadedly connected to) the second end of the pen to cover the tip of the ballpoint/rollerball refill. The smashing cone cover is closed at one end and is provided with a second mounting opening at the opposite end (hereinafter referred to as the second end of the smashing cone cover). The configuration and size of the second mounting opening are such that the second end of the smashing cone cover can be mounted snugly around (e.g., engaged with or threadedly connected to) the first end of the pen to cover the smashing cone of the front section of the smashing rod. The outer periphery of at least one of the pen tip cover and the smashing cone cover is protrudingly provided with a clip adjacent to the closed end so that a user wishing to carry the pen around by putting and storing the pen in a pocket of his or her upper-body garment or trousers can secure the pen to the outer edge of the opening of the pocket via the clip to not only prevent the pen from falling off and getting lost, but also allow the user to take the pen out of the pocket rapidly in response to an emergency.

According to the above, the elastic forces applied to the smashing rod by both the eccentric spring and the compression spring keep the smashing cone exposed from the first end of the pen at normal times. While the smashing cone is not in use, however, the smashing cone cover can be mounted around the outer periphery of the first end of the pen so that the smashing cone exposed from the first end of the pen is stored completely in the smashing cone cover to protect the user as well as people and objects nearby from inadvertent puncture or scratch by the smashing cone. When the user desires to use the smashing cone in an emergency rescue operation or raid, he or she can hold the pen in one hand, grasp the smashing cone cover (or the clip protrudingly provided thereon) with the fingers of the other hand, and displace the smashing cone cover away from the pen to disengage the smashing cone cover from the pen immediately. Thus, the smashing cone is exposed from the first end of the pen at once and can be used to break glass obstacles in the emergency rescue operation or raid.

BRIEF DESCRIPTION OF THE SEVERAL VIEWS OF THE DRAWINGS

The structural features, method of use, and technical appeals of the present invention can be better understood by referring to the following detailed description of some illustrative embodiments in conjunction with the accompanying drawings, in which.

DETAILED DESCRIPTION OF THE INVENTION

In order for a glass smasher to be easily carried around in a pocket of a user's upper-body garment or trousers, the inventor of the present invention designed a novel pen structure with a glass smasher by applying the glass smasher to a pen. A pen is used in the present invention because it is one of the instruments many people would like to carry with them for the purpose of writing or drawing and thereby recording the things happening to them or objects close by. In particular, a police officer of firefighter on duty is almost certain to carry a pen with them in order to use the writing and drawing function of the pen whenever it is necessary to write down or draw what has occurred or has been seen.

According to the first preferred embodiment of the present invention, a glass smasher is mounted at one end of a pen in a way that ensures a compact structure. Thus, apart from being safely portable by a police officer or firefighter to provide its writing and drawing function at any time, the pen is readily accessible during an emergency rescue operation or raid as a glass smashing tool. The smashing cone cover at the front end of the pen can be rapidly removed so that the smashing cone of the front section of a smashing rod in the glass smasher is instantly exposed from the front end of the pen, allowing a police officer or firefighter to precisely control the smashing cone by holding the pen, to apply a force to exactly the same spot on a glass obstacle, and to thereby build up a striking force large enough to reduce the cohesive force in, and eventually shatter, the glass obstacle.

Figure 1:
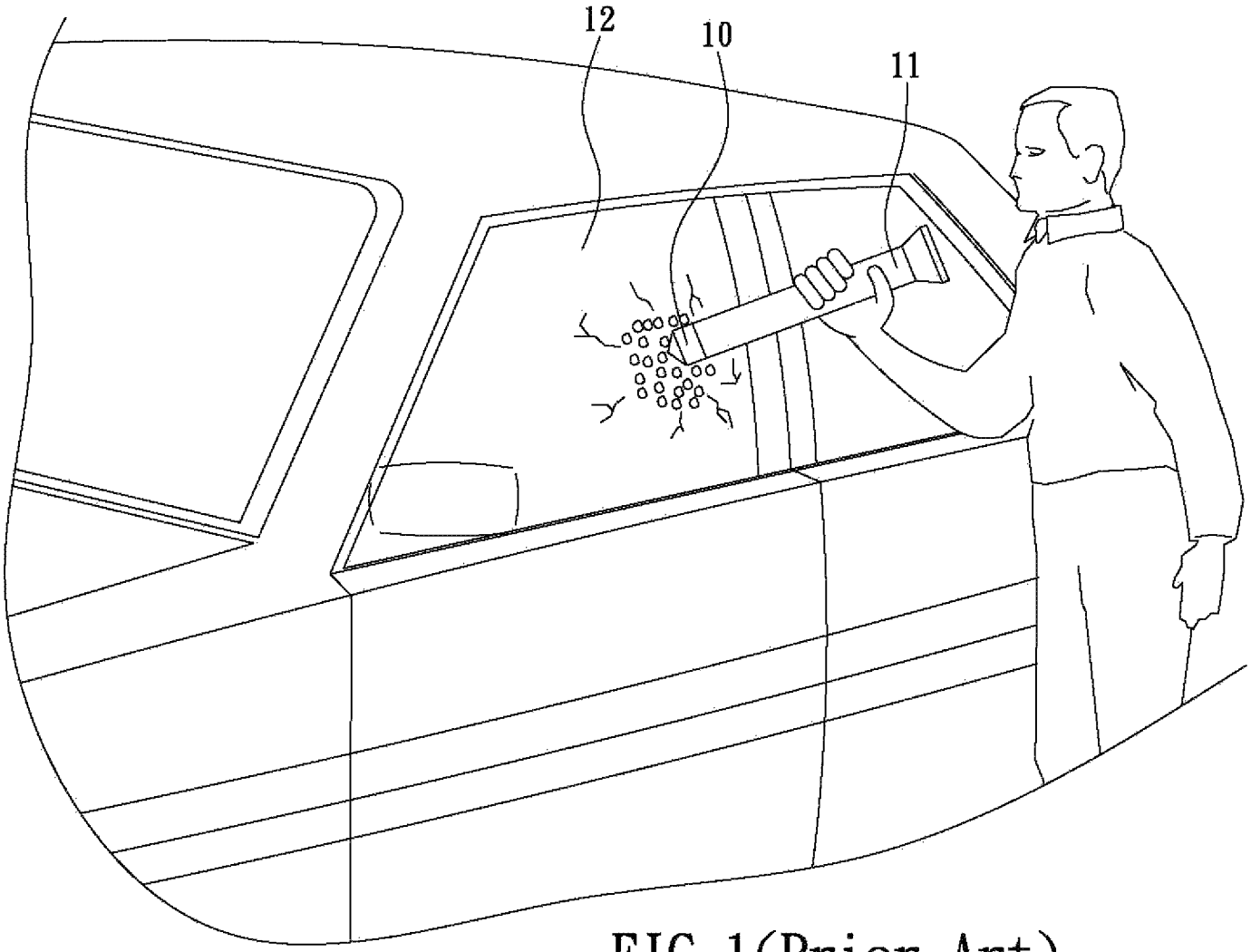
FIG. 1(Prior Art)
FIG. 1 schematically shows a conventional tool for use by police officers and firefighters.
Figure 2:
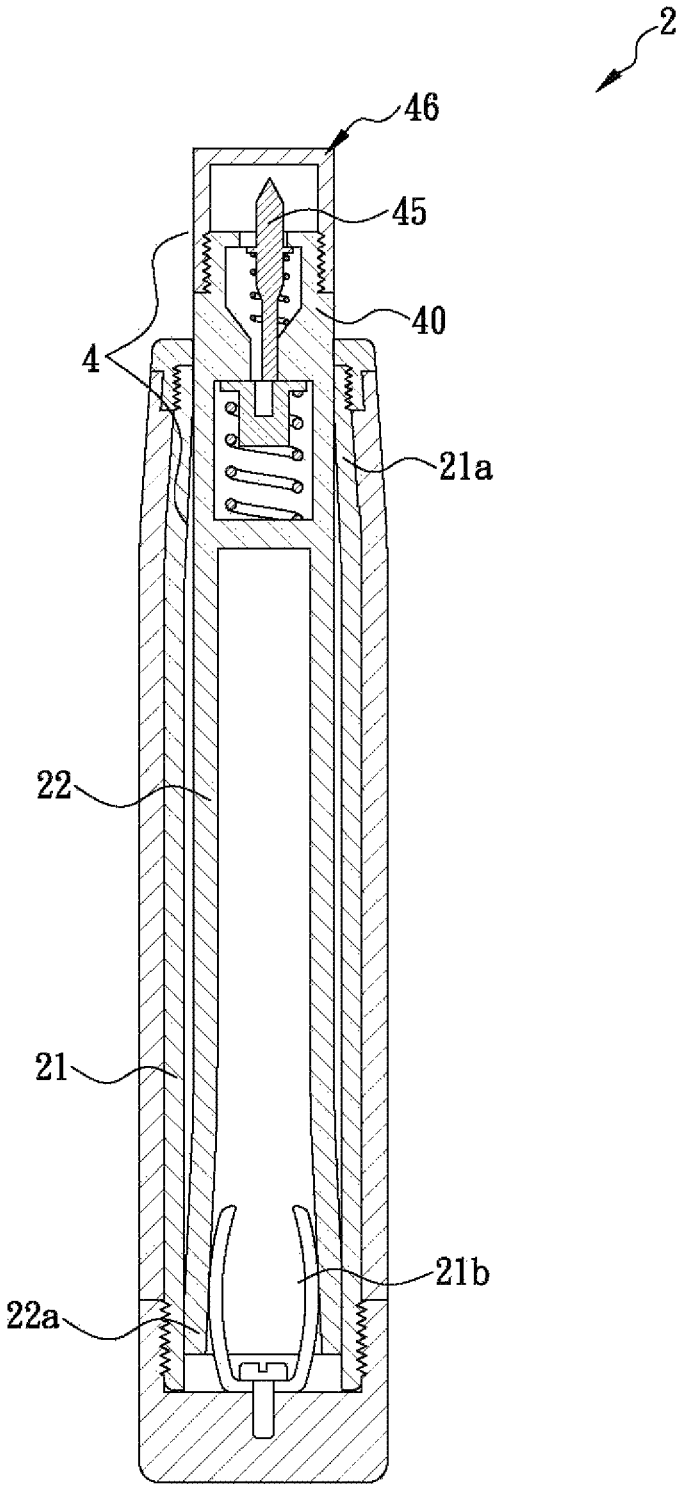
FIG. 2(Prior Art)
FIG. 2 is a sectional view showing the structure of a conventional expandable baton.
Figure 3A:
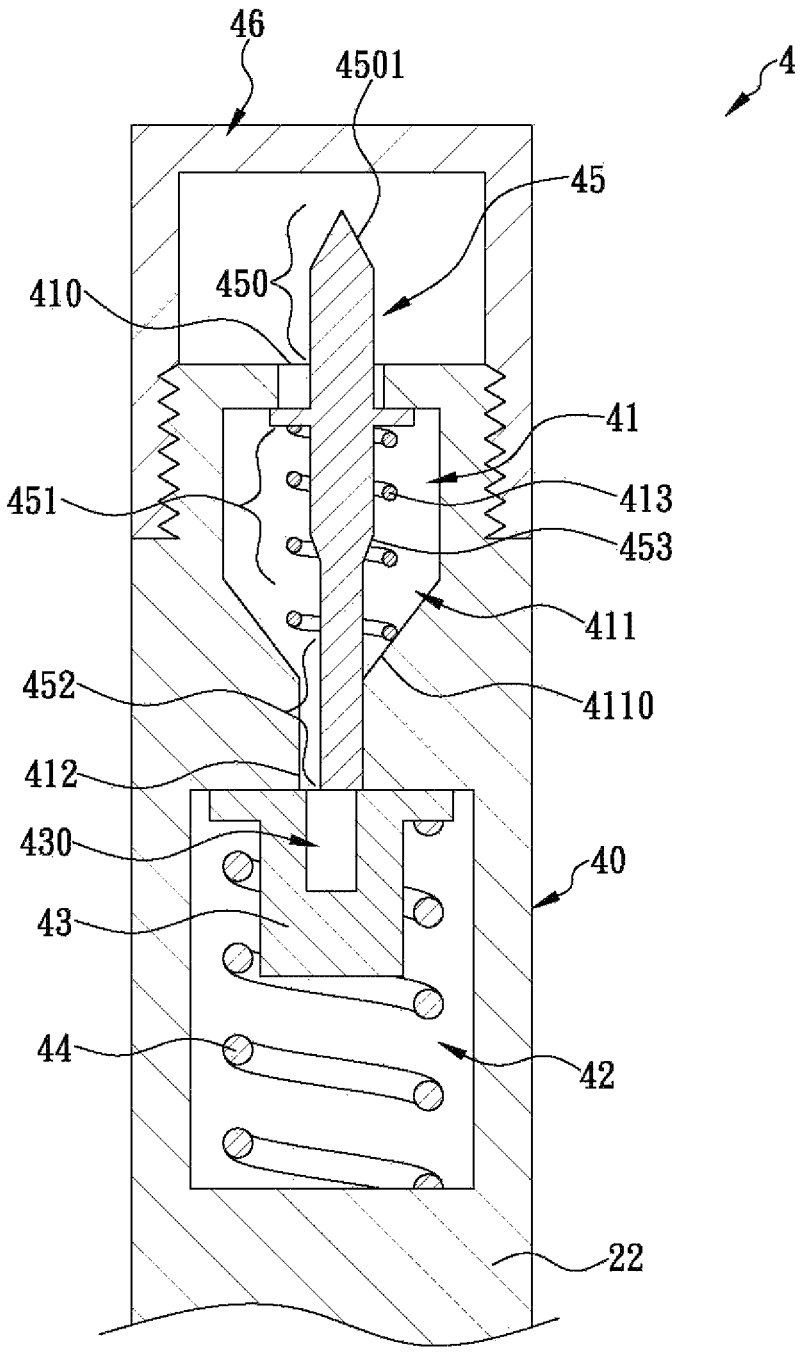
FIG. 3A(Prior Art)
FIG. 3A is a sectional view showing a state of use of the glass smasher at the front end of the inner shaft of the conventional expandable baton in FIG. 2.
Figure 3B:
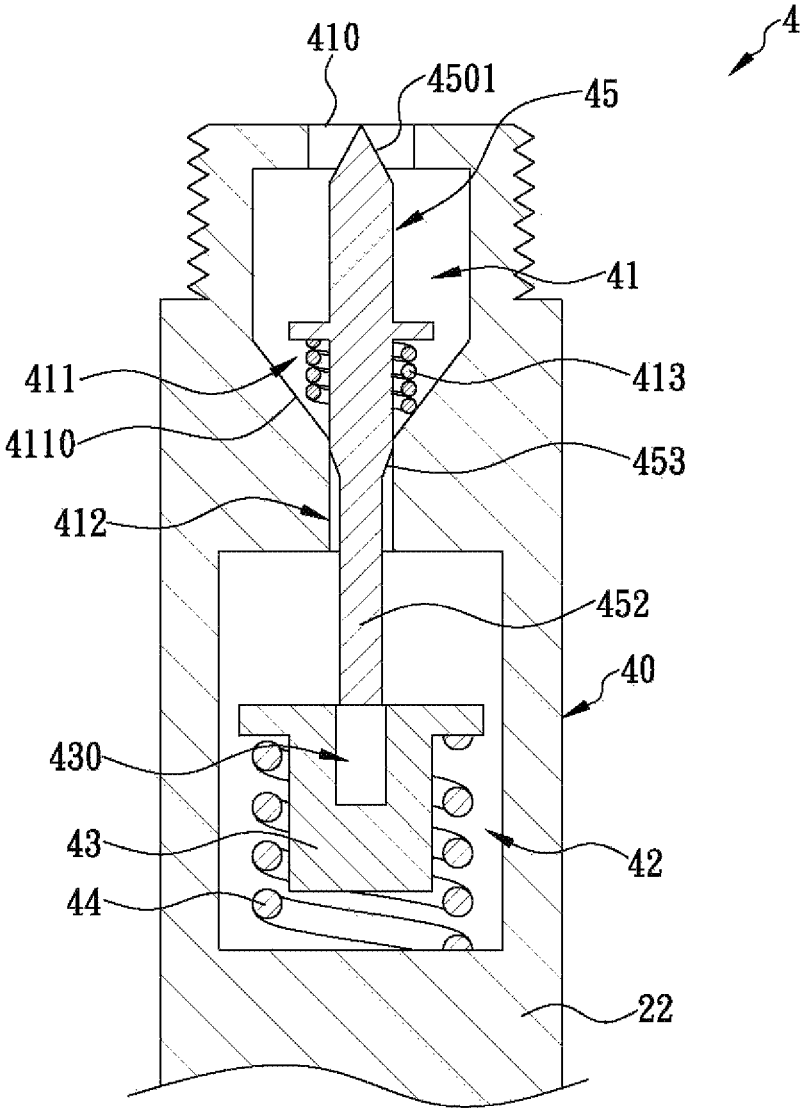
FIG. 3B(Prior Art)
FIG. 3B is a sectional view showing another state of use of the glass smasher at the front end of the inner shaft of the conventional expandable baton in FIG. 2.
Figure 4:
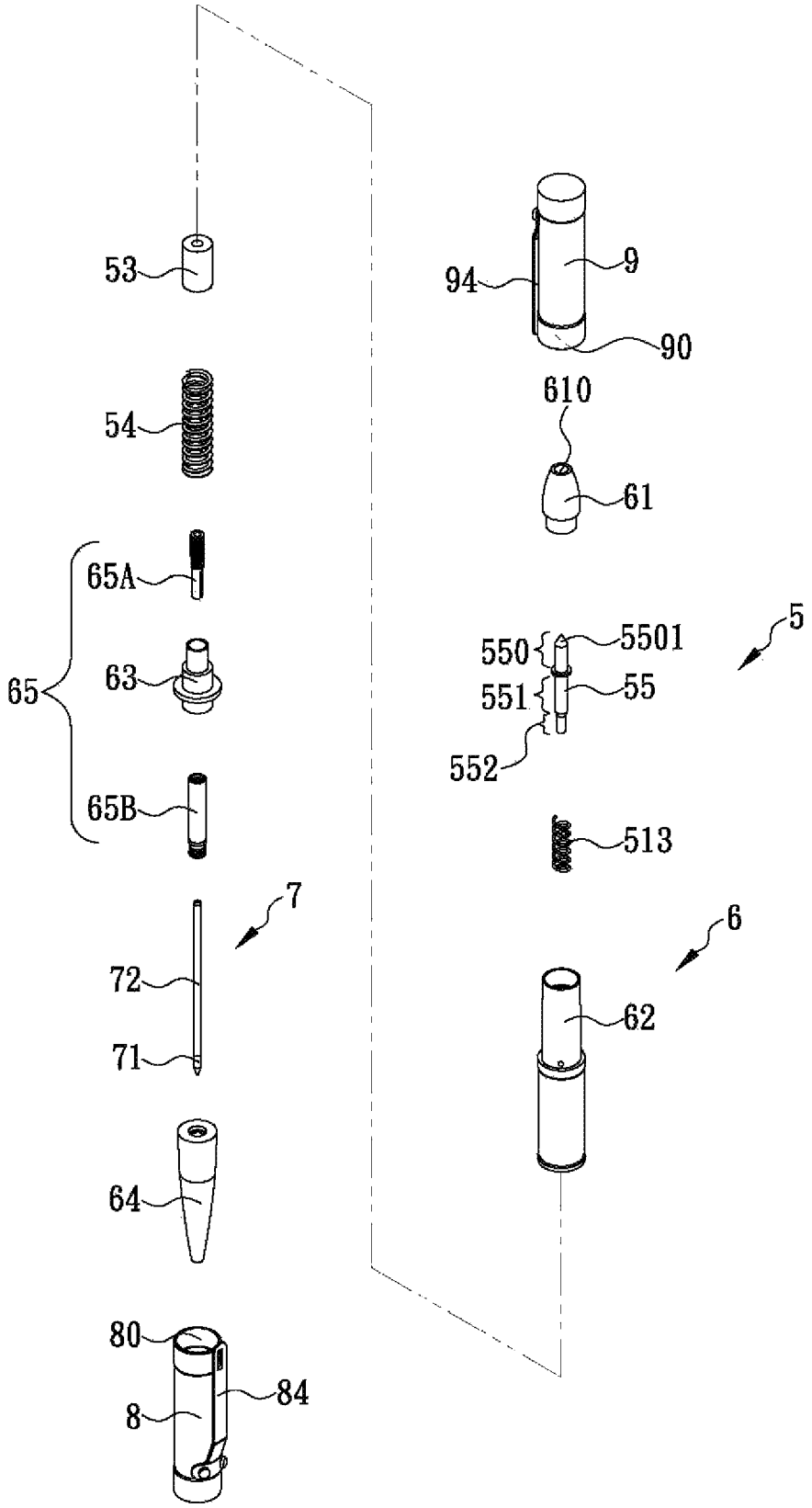
FIG. 4 is an exploded perspective view of the pen structure with a glass smasher according to the first embodiment of the present invention.
Figure 5A:
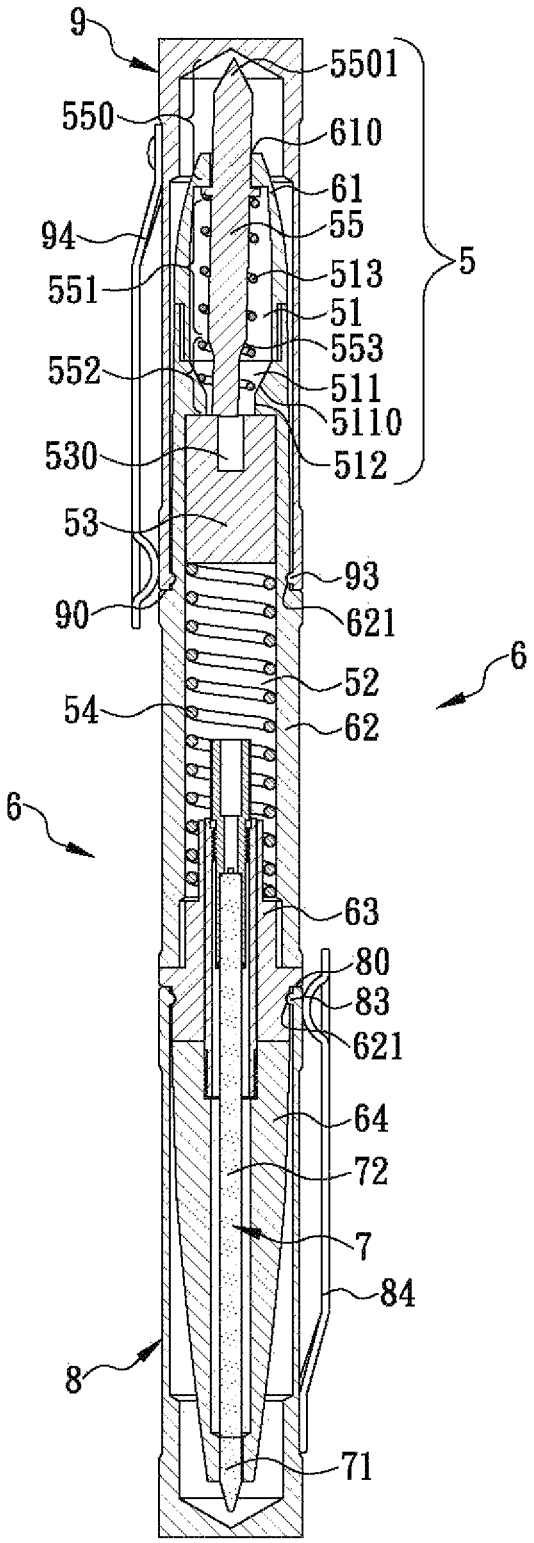
FIG. 5A is a sectional view showing a state of use of the pen structure in FIG. 4.

Referring to FIG. 4 and FIG. 5A for the first preferred embodiment of the present invention, a commonplace ballpoint or rollerball pen is incorporated into this embodiment by way of example not only because of its durability, but also because its typical length and specifications provide portability and ease of grip to facilitate force application. The glass smasher applied to the pen is based on the various glass smashers previously designed and manufactured by the inventor of the present invention but yields the novel structure of the invention. It should be pointed out that the invention is not necessarily applied to a ballpoint/rollerball pen. One who tries to implement the invention may apply the glass smasher structure of the invention to pens of different specifications and properties as needed (e.g., marker pens, colored pencils, laser pointers, and other pointer pens). More specifically, the "pen" referred to herein may vary widely, provided that the smashing cone exposed from the front end of the pen can be rapidly and entirely stored in a smashing cone cover by mounting the smashing cone cover around the outer periphery of the front end of the pen when the glass smasher is not in use, thus not only allowing the pen to be carried around safely and be put to use whenever a specific function of the pen is needed, but also effectively protecting the user as well as people and objects nearby from unintentional puncture or scratch by the smashing cone exposed from the pen; and that when it is desired to use the smashing cone in an emergency rescue operation or raid, the user only has to hold the pen in one hand and grasp and move forward the smashing cone cover with the fingers of the other hand, and the smashing cone cover will be detached from the front end of the pen instantly, allowing the smashing cone to be exposed from the front end of the pen and be used to break glass obstacles in the emergency rescue operation or raid.

As shown in FIG. 4, which shows the first preferred embodiment of the present invention in an exploded perspective view, the glass smasher 5 is applied to a pen and is mounted at one end (e.g., the front or rear end) of the pen. The pen body 6 of the pen includes four barrel sections sequentially connected together, namely a front barrel section 61, a middle barrel section 62, a connecting barrel section 63, and a rear barrel section 64. When applying the present invention, however, the number of the barrel sections may be adjusted to a certain extent according to practical needs. The middle barrel section 62, the connecting barrel section 63, and the rear barrel section 64 jointly form a handle to be gripped by a user. In this embodiment, referring to FIG. 4 and FIG. 5A, the glass smasher 5 includes a smashing rod 55, an eccentric spring 513, an impact block 53, and a compression spring 54. In addition, an impact groove 51, a tapering groove 511, an aligning groove 512, and a compression force application groove 52 are sequentially formed, in a front-to-rear direction, in the pen body 6 of the pen and are in communication with one another. The outer periphery of the middle barrel section 62 is circumferentially and concavely provided with two engaging grooves (or threaded connection grooves) 621 that are adjacent to the front and rear ends of the middle barrel section 62 respectively. The front end of the pen body 6 or of the front barrel section 61 is formed with an aperture 610. The aperture 610 is in communication sequentially with the impact groove 51, the tapering groove 511, the aligning groove 512, and the compression force application groove 52 and has a smaller diameter than the impact groove 51. The tapering groove 511 extends taperingly from the rear end of the impact groove 51 to the front end of the aligning groove 512, and the wall of the tapering groove 511 forms a first tapering pressing surface 5110. The diameter of the aligning groove 512 is smaller than those of the impact groove 51 and of the compression force application groove 52. To facilitate description, the upper end of each component in the drawings is referred to as the "front end", and the lower end, as the "rear end".

As shown in FIG. 5A, the impact block 53 is movably positioned in the compression force application groove 52. The front end of the impact block 53 can be pressed against the wall of the compression force application groove 52 (e.g., a portion of the compression force application groove 52 that is adjacent to the aligning groove 512) and is concavely provided with a striking groove 530. The striking groove 530 corresponds to the aligning groove 512 and has a smaller diameter than the aligning groove 512. The compression spring 54 is positioned in the compression force application groove 52 and has its two ends pressed respectively against the rear end of the impact block 53 and a wall portion of the compression force application groove 52 that is away from the aligning groove 512, in order to push the impact block 53 toward the aligning groove 512 and apply a huge elastic force to the impact block 53.

Figure 5B:
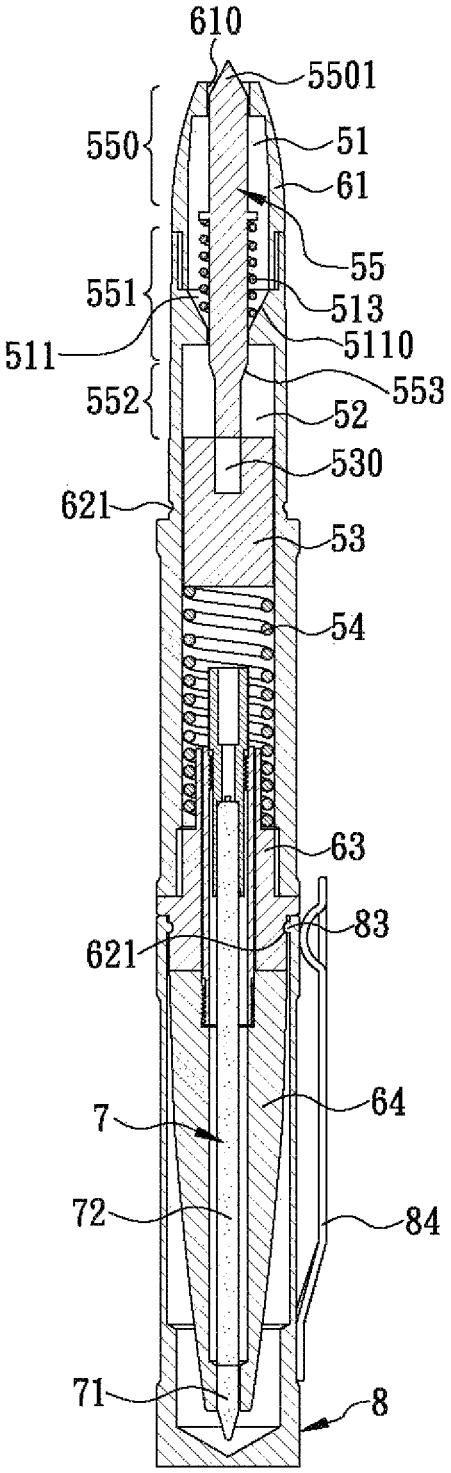
FIG. 5B is a sectional view showing another state of use of the pen structure in FIG. 4.

To facilitate description of the structural features and striking principle of the smashing rod 55, the smashing rod 55 is hereinafter divided into a front section 550, a middle section 551, and a rear section 552. Please note that the smashing rod 55 in FIG. 5B is depicted in the aligned state for the sole purpose of showing the relationship between the smashing rod 55 and the striking groove 530; in practice, the smashing rod 55, when not pushed inward, is in an eccentric state as shown in FIG. 5A, in which state the rear section 552 does not extend into the striking groove 530. The front section 550 of the smashing rod 55 is formed with a smashing cone 5501 at the front end. The middle section 551 matches the aligning groove 512 in diameter, and a wall portion of the middle section 551 that is adjacent to the rear section 552 forms a second tapering pressing surface 553. Normally, the axis of the smashing rod 55 is offset from the axis of the impact block 53 such that the rear end of the rear section 552 of the smashing rod 55 is pressed against the front end of the impact block 53 to prevent the rear section 552 of the smashing rod 55 from extending into the striking groove 530. Thus, with the front end of the impact block 53 pushing back at the rear end of the rear section 552 of the smashing rod 55, the smashing rod 55 is positioned in the impact groove 51, the tapering groove 511, and the aligning groove 512, with the smashing cone 5501 exposed from the front end of the pen body 6 through the aperture 610.

In this embodiment, with continued reference to FIGS. 4-5B, the eccentric spring 513 is positioned in the impact groove 51 and the tapering groove 511, is mounted around a portion of the smashing rod 55 that is adjacent to the middle section 551 and the rear section 552, and has its two ends pressed respectively against a portion of the smashing rod 55 that is adjacent to the front section 550 and the wall of the tapering groove 511, in order to push the smashing rod 55 outward of the aperture 610, thereby exposing the smashing cone 5501 of the front section 550 of the smashing rod 55 from the front end of the pen body 6. The elastic force of the eccentric spring 513 must be smaller than that of the compression spring 54 so that, as soon as the rear section 552 of the smashing rod 55 is in alignment with the striking groove 530, the impact block 53 will strike the rear end of the rear section 552 of the smashing rod 55 under the action of the compression spring 54, and once the smashing cone 5501 completes a striking action on a glass obstacle, the eccentric spring 513 will render the axis of the smashing rod 55 offset from the axis of the impact block 53, thereby moving the rear end of the rear section 552 of the smashing rod 55 away from the striking groove 530 and back to its normal position, i.e., pressed against the front end of the impact block 53 to wait for the next striking action on the glass obstacle.

Referring again to FIG. 4 and FIG. 5A, when a user holding the middle barrel section 62, the connecting barrel section 63, and the rear barrel section 64 of the pen body 6 by their outer peripheries presses the exposed smashing cone 5501 forcibly against a glass obstacle (e.g., one made of tempered glass), the smashing rod 55 and the smashing cone 5501 are gradually displaced toward the compression force application groove 52. When the second tapering pressing surface 553 of the wall of the middle section 551 of the smashing rod 55 is pressed against the first tapering pressing surface 5110, the middle section 551 of the smashing rod 55 begins to be guided by the aligning groove 512 into alignment with the axis of the impact block 53. Now that the middle section 551 of the smashing rod 55 matches the aligning groove 512 in diameter, the instant at which the middle section 551 of the smashing rod 55 becomes perfectly aligned with the striking groove 530, the rear section 552 of the smashing rod 55 thrusts into the striking groove 530, allowing the huge elastic force stored in the compression spring 54 to push the impact block 53 outward. The impact block 53 will in turn strike the rear end of the smashing rod 55, thereby driving the smashing cone 5501 at the front end of the smashing rod 55 to smash the glass obstacle vigorously. Thus, by equipping the pen with the glass smasher 5, the functions and applications of the pen are greatly increased.

With continued reference to FIG. 4 and FIG. 5A, the pen body 6 in this embodiment is detachably provided therein with a ballpoint/rollerball refill 7. The ballpoint/rollerball refill 7 has a ballpoint/rollerball tip 71 and an ink tube 72. The ballpoint/rollerball tip 71 is exposed from the rear end of the pen body 6. The ink tube 72 extends into the compression force application groove 52 of the glass smasher 5 and is positioned in a central portion of the compression spring 54 to make effective use of the unused space in the glass smasher 5, the goal being for the ballpoint/rollerball refill 7 (i.e., the assembly of the ink tube 72 and the ballpoint/rollerball tip 71) to have a length of at least 6 cm so as to hold enough ink for use in writing or drawing for a long time, and for the pen body 6 of the pen to have an overall length of at least 10 cm so as to be easily held by the user while the user writes or draws with the ballpoint/rollerball tip 71 and while the user hits a glass obstacle with the smashing cone 5501 at the front end of the smashing rod 55 in order to smash the glass obstacle. In other embodiments of the present invention, the compression force application groove 52 and the space where the ink tube 72 is located may be isolated from each other to meet product requirements (e.g., with a partition plate provided between the compression force application groove 52 and the space where the ink tube 72 is located); that is to say, communication between the compression force application groove 52 and the space where the ink tube 72 is located is not necessary, provided that the ink tube 72 can extend into and be stored in the pen body 6.

With continued reference to FIG. 4 and FIG. 5A, the pen structure in this embodiment further includes a pen tip cover 8 and a smashing cone cover 9. The pen tip cover 8 is closed at the rear end and is provided with a first mounting opening 80 at the front end. The first mounting opening 80 is so configured and sized that the front end of the pen tip cover 8 can be mounted snugly around (e.g., engaged with or threadedly connected to) the rear end of the pen body 6 to cover the tip 71 of the ballpoint/rollerball refill 7, which tip is exposed from the rear end of the pen body 6. The smashing cone cover 9 is closed at the front end and is provided with a second mounting opening 90 at the opposite end. The second mounting opening 90 is so configured and sized that the rear end of the smashing cone cover 9 can be mounted snugly around (e.g., engaged with or threadedly connected to) the front end of the pen body 6 to cover the smashing cone 5501 of the front section 550 of the smashing rod 55.

In other embodiments of the present invention, referring again to FIG. 4 and FIG. 5A, the outer peripheries of the pen tip cover 8 and of the smashing cone cover 9 are protrudingly provided with clips 84 and 94 respectively, wherein the clips are adjacent to the closed ends of the two covers respectively. Thus, a user wishing to carry the pen around by putting and storing the pen in a pocket of his or her upper-body garment or trousers can fasten the pen to the outer edge of the opening of the pocket with the clip 84 or 94 to keep the pen from falling off and getting lost, but when an emergency takes place, the pen can still be rapidly detached from the pocket and put to use. It is also feasible that only one clip 84 or 94 is provided; i.e., either the pen tip cover 8 has the clip 84 or the smashing cone cover 9 has the clip 94.

Hence, although the smashing cone 5501 of the front section 550 of the smashing rod 55 stays exposed from the front end of the glass smasher 5 as a result of the elastic forces applied by the eccentric spring 513 and the compression spring 54 to the smashing rod 55, a user not intending to use the smashing cone 5501 can mount the smashing cone cover 9 axially to the outer periphery of the front end of the pen body 6, as shown in FIG. 5A, so that the smashing cone 5501 exposed from the front end of the pen body 6 is rapidly and completely stored in the smashing cone cover 9, and by doing so, the user as well people and objects nearby is effectively protected from inadvertent puncture or scratch by the smashing cone 5501. When the user desires to use the smashing cone 5501 in an emergency rescue operation or raid, referring to FIG. 5B in conjunction with FIG. 4, he or she can grasp the smashing cone cover 9 (or the clip 94 protrudingly provided thereon) with the fingers of one hand while holding the pen body 6 with the other hand and displace the smashing cone cover 9 axially forward, thereby releasing the smashing cone cover 9 from engagement (or threaded connection) with the corresponding engaging groove (or threaded connection groove) 621 and removing the smashing cone cover 9 from the front end of the pen body 6 rapidly. The smashing cone 5501, therefore, is promptly exposed from the front end of the pen body 6 and can be used to break glass obstacles in the emergency rescue operation or raid.

Besides, referring to FIGS. 4, 5A, and 5B, the inner walls of the pen tip cover 8 and of the smashing cone cover 9 in this embodiment are circumferentially and protrudingly provided with packing rings (or threaded connection rings) 83 and 93 respectively, wherein the packing rings (or threaded connection rings) are adjacent to the first mounting opening 80 and the second mounting opening 90 respectively. Once the front end of the pen tip cover 8 is mounted around the rear end of the pen body 6 and covers the ballpoint/rollerball tip 71 of the ballpoint/rollerball refill 7 exposed from the rear end of the pen body 6, the packing ring (or threaded connection ring) 83 protrudingly provided on the inner wall of the pen tip cover 8 is tightly engaged in (or threadedly connected with) the engaging groove (or threaded connection groove) 621 concavely provided in a rear end portion of the middle barrel section 62, thereby preventing the pen tip cover 8 from unintended separation and ensuring that the ink on the ballpoint/rollerball tip 71 of the ballpoint/rollerball refill 7 will not stain the user's clothes or other objects. And once the rear end of the smashing cone cover 9 is mounted around the front end of the pen body 6 and covers the smashing cone 5501 exposed from the front end of the pen body 6, the packing ring (or threaded connection ring) 93 protrudingly provided on the inner wall of the smashing cone cover 9 is tightly engaged in (or threadedly connected with) the engaging groove (threaded connection groove) 621 concavely provided in a front end portion of the middle barrel section 62, thereby preventing the smashing cone cover 9 from unintended separation and protecting the user as well as people and objects nearby from being inadvertently punctured or scratched by the smashing cone 5501.

In order for the glass smasher 5 in this embodiment to have high and effective smashing power, the front section 550 of the smashing rod 55 and the smashing cone 5501 can be made of spring steel, bearing steel, or the like (or the smashing rod 55 is integrally formed of spring steel or bearing steel), with a view to achieving a Rockwell hardness value of 58 or above, which ensures that the smashing cone 5501 can smash objects made of tempered glass of various grades. Moreover, the longitudinal length of the rear section 552 of the smashing rod 55 is greater than the longitudinal depth of the striking groove 530, and the diameter of the rear section 552 is smaller than that of the striking groove 530. Thus, when the rear section 552 of the smashing rod 55 extends into the striking groove 530 upon alignment therewith, the compression spring 54 can transfer the huge impact energy stored therein to the smashing rod 55 through the impact block 53, thereby enabling the smashing cone 5501 at the front end of the smashing rod 55 to smash objects of various strengths vigorously. Furthermore, while the pen body 6 in this embodiment is an independent element assembled from four barrel sections 61, 62, 63, and 64, the pen body 6 in another embodiment of the present invention may include a different number of barrel sections sequentially put together to satisfy practical needs. More specifically, the "pen body 6" in the present invention may vary in structure, provided that the impact groove 51, the tapering groove 511, the aligning groove 512, and the compression force application groove 52 are sequentially formed in the pen body 6 in the front-to-rear direction and are in communication with one another; and that the front end of the pen body 6 is formed with the aperture 610 in communication sequentially with the impact groove 51, the tapering groove 511, the aligning groove 512, and the compression force application groove 52 to enable the smashing function and effect of the glass smasher 5.

Figure 6A:
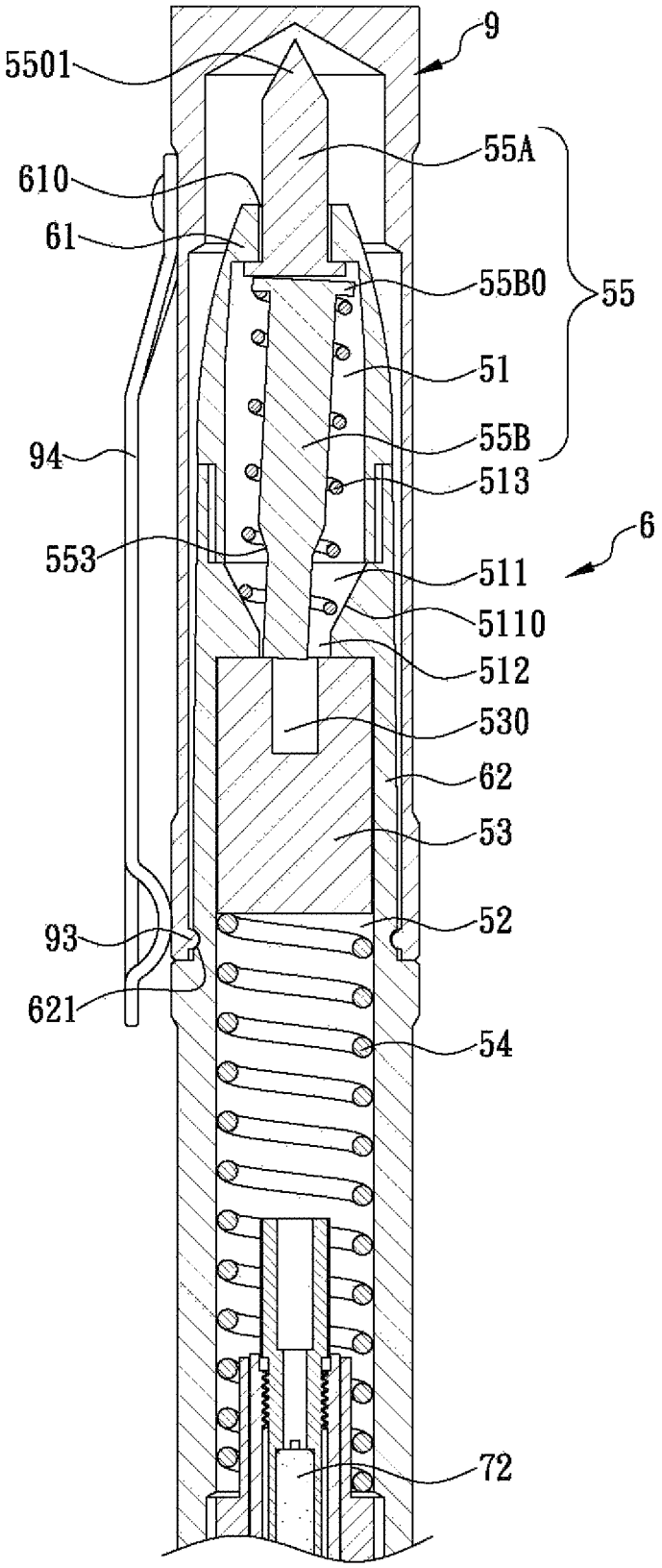
FIG. 6A is a sectional view showing a state of use of the pen structure with a glass smasher according to the second embodiment of the present invention.
Figure 6B:
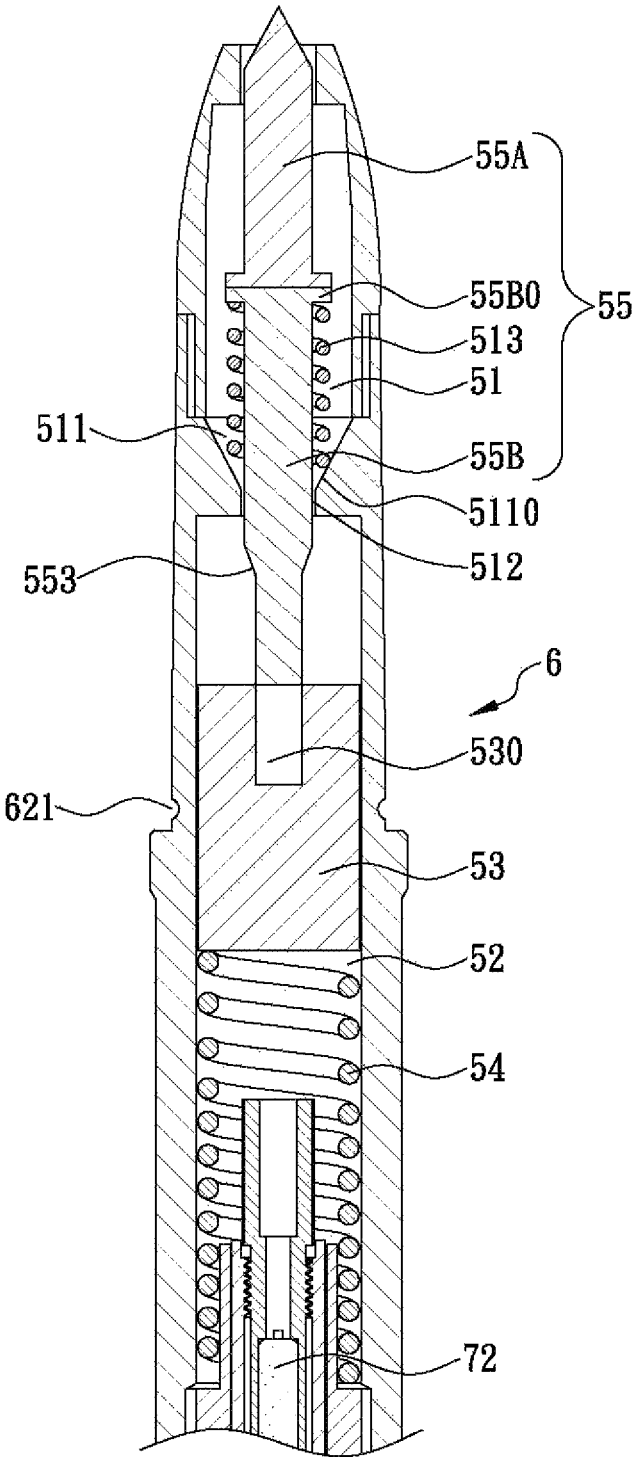
FIG. 6B is a sectional view showing another state of use of the pen structure in FIG. 6A.

In the second preferred embodiment of the present invention as shown in FIGS. 6A and 6B, the smashing rod 55 is no longer an independent and integrally formed element as in the foregoing embodiment but includes a first smashing rod 55A and a second smashing rod 55B. The smashing rods 55A and 55B may be made of different materials respectively. For example, the first smashing rod 55A is made of spring steel while the second smashing rod 55B is made of a softer material. The first smashing rod 55A is equivalent to the "front section 550" in the previous embodiment (see FIG. 5A), and the second smashing rod 55B, to the "middle section 551 and rear section 552" in the previous embodiment. The two ends of the eccentric spring 513 are pressed respectively against the second smashing rod 55B (e.g., a shoulder portion 55B0 protrudingly provided at the front end of the second smashing rod 55B) and the wall of the tapering groove 511. The front end of the second smashing rod 55B is configured to push the rear end of the first smashing rod 55A toward the aperture 610 and thereby displace the front end of the first smashing rod 55A outward of the aperture 610, exposing the smashing cone 5501 at the front end of the first smashing rod 55A from the front end of the pen body 6 through the aperture 610. This "two-section" structure of the smashing rod 55 is so designed that the first smashing rod 55A is not integrally formed with but is to be pushed outward by the second smashing rod 55B. Therefore, even though the second smashing rod 55B is tilted (as shown in FIG. 6A, in which the axis of the second smashing rod 55B is offset from that of the impact block 53) while the smashing cone 5501 at the front end of the first smashing rod 55A is not pressed against any glass obstacle, the axis of the first smashing rod 55A can stay parallel to that of the impact block 53, allowing the smashing cone 5501 at the front end of the first smashing rod 55A to be exposed perpendicularly from the front end of the pen body 6 through the aperture 610. This not only gives the entire pen structure a neat and visually pleasing look, but also makes it easier for a user to aim the smashing cone 5501 precisely at a smashing point on a to-be-smashed glass obstacle in front of the smashing rod 55, break the glass obstacle by striking the same point repeatedly, and thereby achieve success in an emergency rescue or raid.

Figure 7A:
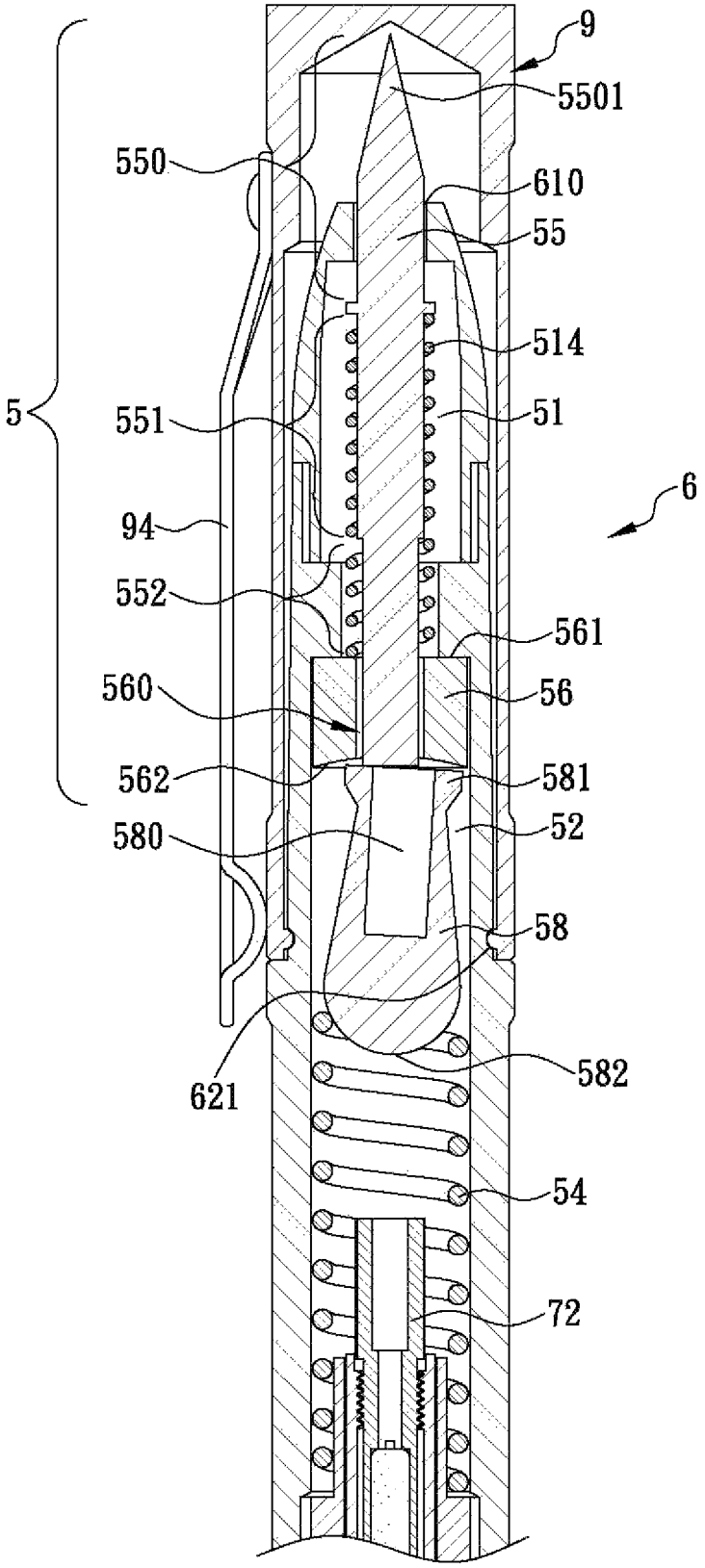
FIG. 7A is a sectional view showing a state of use of the pen structure with a glass smasher according to the third embodiment of the present invention.
Figure 7B:
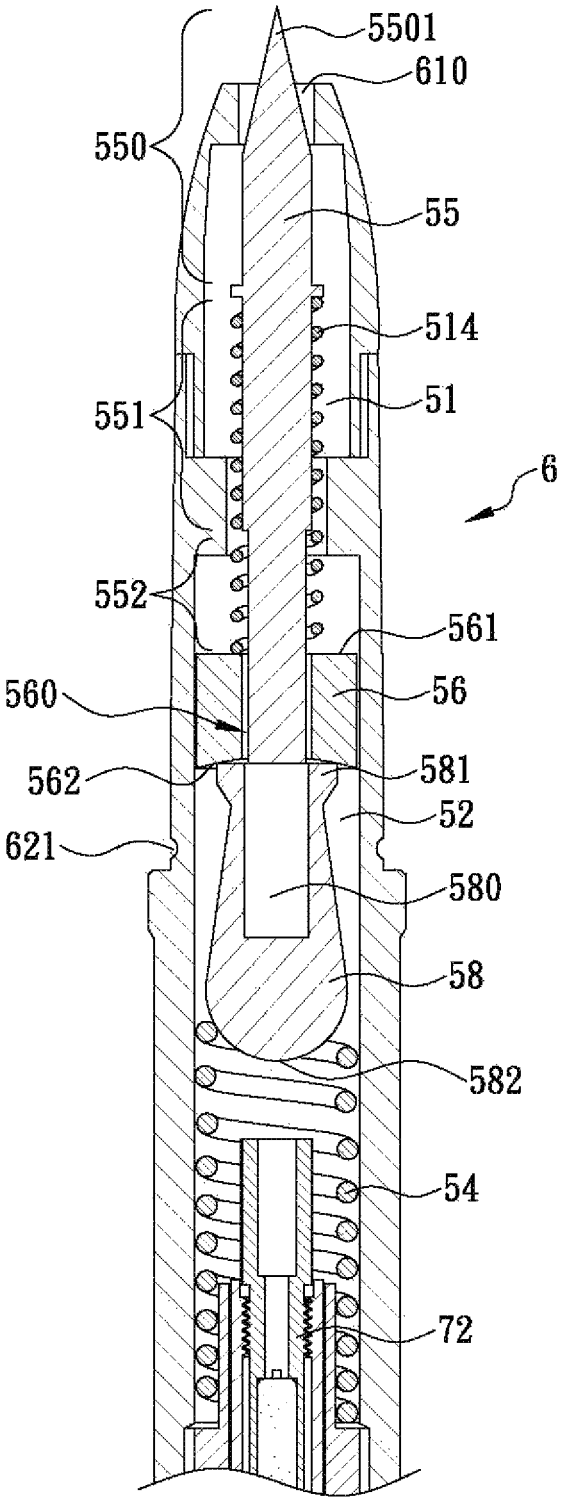
FIG. 7B is a sectional view showing another state of use of the pen structure in FIG. 7A.

Moreover, to effectively simplify the internal structure of the pen body 6 in each of the foregoing embodiments, the pen body 6 and the glass smasher 5 may, as appropriate, be structured as shown in FIG. 7A and FIG. 7B, which show the third preferred embodiment of the present invention. In the third preferred embodiment, the glass smasher 5 is provided at the front end of the pen body 6 and includes a smashing rod 55, a guide spring 514, a guide block 56, an offset striking block 58, and a compression spring 54. An impact groove 51 and a compression force application groove 52 are sequentially formed, in a front-to-rear direction, in the pen body 6 and are in communication with each other. The outer periphery of the pen body 6 is circumferentially and concavely provided with an engaging groove (or threaded connection groove) 621 adjacent to the front end of the pen body 6. The front end of the pen body 6 is formed with an aperture 610, which is in communication sequentially with the impact groove 51 and the compression force application groove 52, and whose diameter is smaller than those of the impact groove 51 and of the compression force application groove 52.

To facilitate description of the structural features and striking principle of the smashing rod 55 in this embodiment, the smashing rod 55 is also divided into a front section 550, a middle section 551, and a rear section 552, as shown in FIG. 7A and FIG. 7B. The guide spring 514 is mounted around the smashing rod 55 at a position adjacent to the middle section 551 and the rear section 552. The front end of the guide spring 514 is pressed against a portion of the smashing rod 55 that is adjacent to the front section 550. The rear end of the guide spring 514 is pressed against a front-end wall 561 of the guide block 56. The guide block 56 is movably positioned in the compression force application groove 52. The front-end wall 561 of the guide block 56 can be pressed against the wall of the compression force application groove 52 (e.g., a portion of the compression force application groove 52 that is adjacent to the impact groove 51) and is concavely provided with a guide groove 560. The guide block 56 is so designed that, once the rear section 552 of the smashing rod 55 passes through the guide groove 560, the rear end of the smashing rod 55 is pressed against a front-end side 581 of the offset striking block 58. The offset striking block 58 is movably positioned in the compression force application groove 52. The front-end side 581 of the offset striking block 58 can be pressed against a rear-end wall 562 of the guide block 56 and is concavely provided with an offset striking groove 580 corresponding to the guide groove 560. The front-end side 581 or a rear-end side 582 of the offset striking block 58 forms a curved guide surface (e.g., a central portion of the front-end side 581 or of the rear-end side 582 of the offset striking block 58 has a curved surface adjacent to the offset striking groove 580). The front-end wall 561 or the rear-end wall 562 of the guide block 56 also forms a curved guide surface (e.g., a central portion of the rear-end wall 562 of the guide block 56 has a curved surface adjacent to the guide groove 560). The compression spring 54 is positioned in the compression force application groove 52. The front end of the compression spring 54 is pressed against the rear-end side 582 of the offset striking block 58, and the rear end of the compression spring 54 is pressed against the wall of the compression force application groove 52, in order for the compression spring 54 to push the offset striking block 58 toward the impact groove 51 and apply a huge elastic force to the offset striking block 58. As the front-end side 581 or the rear-end side 582 of the offset striking block 58 forms a curved guide surface and so does the front-end wall 561 or the rear-end wall 562 of the guide block 56, the curved guide surfaces can fine-tune the angles and positions of the compression spring 54 and of the offset striking block 58 while the compression spring 54 is being compressed, thereby bringing the offset striking groove 580 in the offset striking block 58 into alignment with the guide groove 560, allowing the rear section 552 of the smashing rod 55 to be guided into the offset striking groove 580 immediately after the rear section 552 extends through the guide groove 560.

In FIG. 7B, the smashing rod 55 is depicted in the aligned state for the sole purpose of showing the relationship between the smashing rod 55 and the offset striking groove 580 right before the smashing cone 5501 of the front section 550 of the smashing rod 55 smashes a glass obstacle. In practice, referring back to FIG. 7A, the rear section 552 of the smashing rod 55 is offset from and hence will not extend into the offset striking groove 580 before the front section 550 of the smashing rod 55 is pushed inward. The front section 550 of the smashing rod 55 is formed with the smashing cone 5501, and the middle section 551 and the rear section 552 of the smashing rod 55 match the guide groove 560 in diameter so that, once the rear section 552 of the smashing rod 55 extends through the guide groove 560, the axis of the smashing rod 55 is offset from the axis of the offset striking block 58, with the rear end of the rear section 552 of the smashing rod 55 pressed against the front-end side 581 of the offset striking block 58 to prevent the rear section 552 of the smashing rod 55 from extending into the offset striking groove 580. The front-end side 581 of the offset striking block 58 can therefore push the rear end of the rear section 552 of the smashing rod 55, thereby positioning the smashing rod 55 in the impact groove 51 and the compression force application groove 52 while exposing the front section 550 of the smashing rod 55 and the smashing cone 5501 from the front end of the pen body 6 through the aperture 610.

In the third embodiment, with continued reference to FIGS. 7A and 7B, the guide spring 514 is positioned in the impact groove 51 and is mounted around the smashing rod 55 at a position adjacent to the middle section 551 and the rear section 552. Moreover, the two ends of the guide spring 514 are pressed respectively against a portion of the smashing rod 55 that is adjacent to the front section 550 and the front-end wall 561 of the guide block 56, in order for the guide spring 514 to push the smashing rod 55 outward of the aperture 610, thereby exposing the smashing cone 5501 of the front section 550 of the smashing rod 55 from the front end of the pen body 6. The elastic force of the guide spring 514 must be smaller than that of the compression spring 54 so that, once the rear end of the rear section 552 of the smashing rod 55 is fine-tuned into alignment with the offset striking groove 580, the front-end side 581 of the offset striking block 58 will strike the rear end of the rear section 552 of the smashing rod 55 under the action of the compression spring 54, and when the smashing cone 5501 completes the intended striking and smashing action on a glass obstacle, the guide spring 514, the curved guide surface of the rear-end wall 562 of the guide block 56, and the curved guide surface of the rear-end side 582 of the offset striking block 58 will render the axis of the smashing rod 55 offset from the axis of the offset striking block 58, thereby moving the rear end of the rear section 552 of the smashing rod 55 away from the offset striking groove 580 and back to its normal position, i.e., pressed against the front-end side 581 of the offset striking block 58 to wait for the next striking and smashing operation.

In the third embodiment, as shown in FIG. 7A and stated above, the front-end wall 561 of the guide block 56 can be pressed against the wall of the compression force application groove 52 (e.g., a portion of the compression force application groove 52 that is adjacent to the impact groove 51). In another embodiment of the present invention, however, the guide spring 514 may be strong enough to keep the front-end wall 561 of the guide block 56 from being pressed against the wall of the compression force application groove 52; in that case, the interior of the pen body 6 may be designed as a straight tube without the shoulder portion that protrudes radially inward from a wall portion of the compression force application groove 52 that is adjacent to the impact groove 51.

Figure 8A:
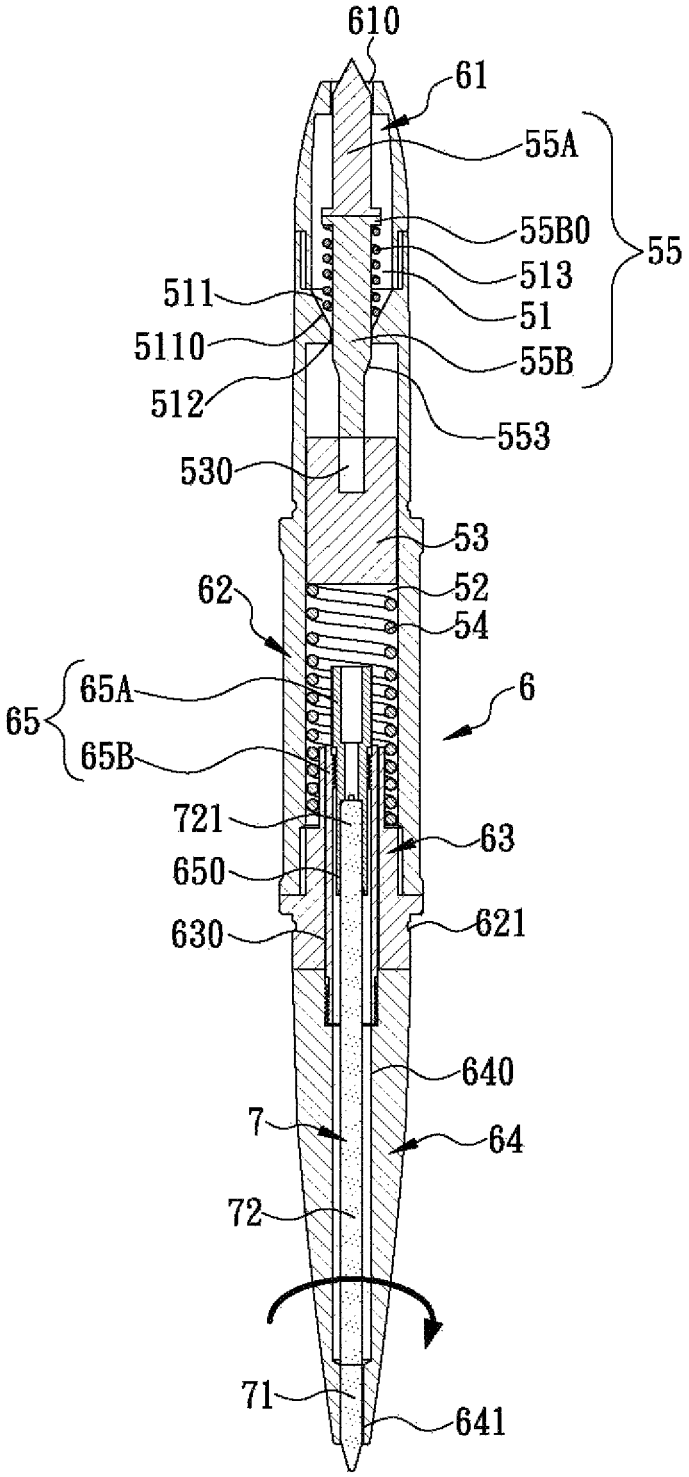
FIG. 8A is a sectional view of the pen body of a pen structure with a glass smasher according to the present invention, with the ballpoint/rollerball tip exposed from the rear end of the rear barrel section.
Figure 8B:
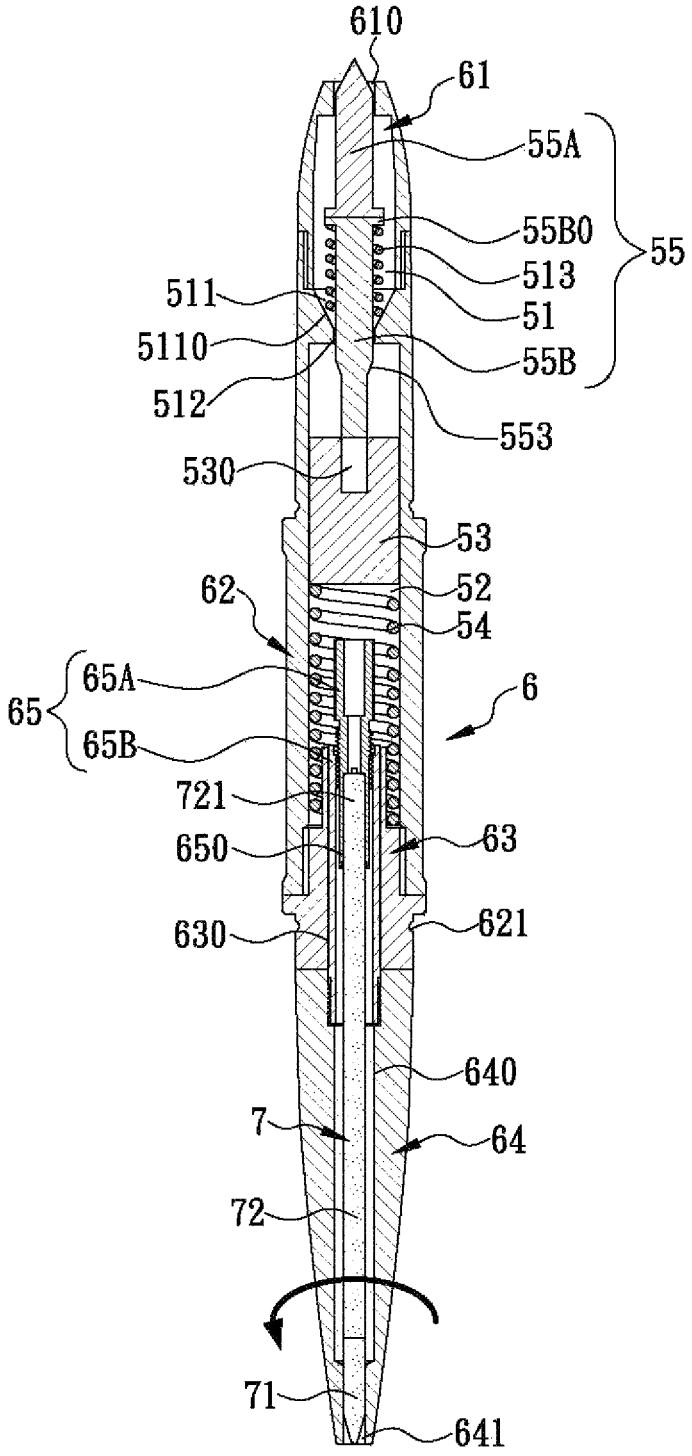
FIG. 8B is similar to FIG. 8A except that the ballpoint/rollerball tip is stored and hidden in the second receiving space in the rear barrel section.

To simplify the overall structure and assembly process of the pen, the pen tip cover 8 may be dispensed with in other embodiments of the present invention, and in order to ensure that the ink in the ink tube 72 will not leak through the ballpoint/rollerball tip 71 exposed from the rear end of the pen body 6 and stain the user's clothes or other objects, the pen body 6 of the pen can be designed as follows. Referring to FIGS. 8A and 8B in conjunction with FIG. 4, the pen body 6 of the pen includes four barrel sections (i.e., the front barrel section 61, the middle barrel section 62, the connecting barrel section 63, and the rear barrel section 64) sequentially connected together. The aperture 610 is formed at the front end of the front barrel section 61. The impact groove 51 is formed in the front barrel section 61 at a position away from the aperture 610 but is in communication with the aperture 610. The front end of the middle barrel section 62 is connected to (e.g., engaged or threadedly connected with) the rear end of the front barrel section 61. The tapering groove 511, the aligning groove 512, and the compression force application groove 52 are sequentially formed, in a front-to-rear direction, in the middle barrel section 62 and are in communication with one another (in the third embodiment, however, only the compression force application groove 52 is formed in the middle barrel section 62). The front end of the connecting barrel section 63 is connected to (e.g., engaged or threadedly connected with) the rear end of the middle barrel section 62, and the rear end of the connecting barrel section 63 is connected to (e.g., engaged or threadedly connected with) the front end of the rear barrel section 64. The connecting barrel section 63 and the rear barrel section 64 are provided therein with a first receiving space 630 and a second receiving space 640 respectively. The first receiving space 630 and the second receiving space 640 are in communication with each other and are configured for receiving the ballpoint/rollerball refill 7. The rear end of the rear barrel section 64 is formed with a pen opening 641 in communication with the second receiving space 640 so that not only can the ballpoint/rollerball tip 71 of the ballpoint/rollerball refill 7 be exposed from the rear end of the rear barrel section 64 through the pen opening 641, but also the ink tube 72 of the ballpoint/rollerball refill 7 can extend sequentially through the second receiving space 640 and the first receiving space 630 into the compression force application groove 52.

In addition, with continued reference to FIGS. 8A and 8B, the pen body 6 of the pen is provided therein with an ink tube positioning member 65 (which is depicted in FIG. 4 as a transmission assembly consisting of two members 65A and 65B but is not necessarily so configured). The rear end of the ink tube positioning member 65 is connected to (e.g., engaged or threadedly connected with) the front end of the connecting barrel section 63 while the front end of the ink tube positioning member 65 extends into the compression force application groove 52. The ink tube positioning member 65 is provided therein with an ink tube positioning space 650 in which to position a portion 721 of the ink tube 72 that is away from the ballpoint/rollerball tip 71, thereby preventing the ink tube 72 from falling off. The front end of the rear barrel section 64 is movably connected to the rear end of the ink tube positioning member 65 or the rear end of the connecting barrel section 63. Thus, when a user wishes to write or draw with the ballpoint/rollerball tip 71, he or she only has to turn the rear barrel section 64 with fingers (e.g., in the direction indicated by the arrow in FIG. 8A), and the rear barrel section 64 will drive the ink tube positioning member 65 and thereby push the ballpoint/rollerball tip 71 of the ballpoint/rollerball refill 7 outward through the pen opening 641, in order for the user to write or draw with the ballpoint/rollerball tip 71 exposed from the rear end of the rear barrel section 64. When the user no longer needs to use the ballpoint/rollerball tip 71, he or she only has to turn the rear barrel section 64 with fingers in the opposite direction (e.g., in the direction indicated by the arrow in FIG. 8B), and the rear barrel section 64 will drive the ink tube positioning member 65 again and thereby retract the ballpoint/rollerball tip 71 of the ballpoint/rollerball refill 7 through the pen opening 641 so that the ballpoint/rollerball tip 71 is stored and hidden in the second receiving space 640 of the rear barrel section 64. In other embodiments of the present invention, other structures may be used instead to render the ballpoint/rollerball tip 71 stored in or exposed from the pen body 6.

While the invention herein disclosed has been described by means of specific embodiments, numerous modifications and variations could be made thereto by those skilled in the art without departing from the scope of the invention set forth in the claims.

What is claimed is:

1. A pen structure with a glass smasher, comprising:

a pen body having a front end formed with an aperture, wherein the pen body is provided therein, sequentially in a front-to-rear direction, with an impact groove, a tapering groove, an aligning groove, and a compression force application groove; the aperture is in communication with the impact groove, the tapering groove, the aligning groove, and the compression force application groove sequentially; the aperture has a smaller diameter than the impact groove; the tapering groove extends taperingly from a rear end of the impact groove to a front end of the aligning groove and has a wall forming a first tapering pressing surface; and the aligning groove has a smaller diameter than the impact groove and the compression force application groove;

the glass smasher, mounted in the pen body at a position adjacent to the front end of the pen body and comprising:

a smashing rod having a front section formed with a smashing cone, a middle section matching the aligning groove in diameter, and a rear section, wherein the middle section has a wall forming a second tapering pressing surface adjacent to the rear section;

an eccentric spring mounted around a periphery of the middle section of the smashing rod and forcing an axis of the smashing rod to be offset from an axis of an impact block such that a rear end of the rear section of the smashing rod is pressed against a front end of the impact block, preventing the rear section of the smashing rod from extending into a striking groove;

the impact block, movably positioned in the compression force application groove, wherein the front end of the impact block is able to be pressed against a wall of the compression force application groove and is concavely provided with the striking groove, the striking groove corresponds to the aligning groove, and the striking groove has a smaller diameter than the aligning groove; and a compression spring positioned in the compression force application groove and having two ends pressed respectively against a rear end of the impact block and a wall portion of the compression force application groove that is away from the aligning groove, in order to push the impact block toward the aligning groove and thus push the front end of the impact block against the rear end of the rear section of the smashing rod, thereby positioning the smashing rod in the impact groove, the tapering groove, and the aligning groove, with the smashing cone exposed from the front end of the pen body through the aperture, wherein when the smashing cone is pressed forcibly against a glass obstacle, the smashing rod is gradually displaced toward the compression force application groove; when the second tapering pressing surface of the wall of the middle section of the smashing rod is consequently pressed against the first tapering pressing surface, the middle section of the smashing rod begins to be guided by the aligning groove into alignment with the axis of the impact block; and as soon as the middle section of the smashing rod is in perfect alignment with the striking groove, the rear section of the smashing rod extends into the striking groove such that the impact block is forced outward by a huge elastic force stored in the compression spring and strikes a rear end of the smashing rod, thereby driving the smashing cone at a front end of the smashing rod to smash the glass obstacle forcibly; and a ballpoint/rollerball refill detachably provided in the pen body, wherein the ballpoint/rollerball refill has a ballpoint/rollerball tip and an ink tube, the ballpoint/rollerball tip is exposed from a rear end of the pen body, and the ink tube extends into the pen body in order for the ballpoint/rollerball refill to have a length of at least 6 cm and therefore be able to hold enough ink for use in writing or drawing for a long time, and for the pen body to have an overall length of at least 10 cm and therefore be able to be easily held by a user while the user writes or draws with the ballpoint/rollerball tip and while the user applies a force to the glass obstacle through the smashing cone at the front end of the smashing rod to smash the glass obstacle, wherein the ink tube of the ballpoint/rollerball refill extends into the compression force application groove and is positioned in a central portion of the compression spring to make effective use of unused space in the glass smasher.

2. The pen structure of claim 1, wherein the front end of the impact block is able to be pressed against a wall portion of the compression force application groove that is adjacent to the aligning groove.

3. The pen structure of claim 2, wherein the rear section of the smashing rod has a longitudinal length greater than a longitudinal depth of the striking groove.

4. The pen structure of claim 3, wherein the pen body has an outer periphery circumferentially and concavely provided with an engaging groove or threaded connection groove adjacent to at least one of the front end and the rear end of the pen body.

5. The pen structure of claim 4, wherein the smashing rod comprises a first smashing rod and a second smashing rod, and the eccentric spring has two ends pressed respectively against the second smashing rod and the wall of the tapering groove such that a front end of the second smashing rod pushes a rear end of the first smashing rod outward of the aperture, thereby exposing the smashing cone at a front end of the first smashing rod from the front end of the pen body through the aperture.

6. The pen structure of claim 5, wherein the pen body comprises a front barrel section, a middle barrel section, a connecting barrel section, and a rear barrel section sequentially connected together; the aperture is formed at a front end of the front barrel section; the impact groove is formed in the front barrel section at a position away from the aperture but is in communication with the aperture; the middle barrel section has a front end connected to a rear end of the front barrel section; the tapering groove, the aligning groove, and the compression force application groove are sequentially formed in the middle barrel section in the front-to-rear direction and are in communication with one another; the connecting barrel section has a front end connected to a rear end of the middle barrel section and has a rear end connected to a front end of the rear barrel section; the connecting barrel section and the rear barrel section are provided therein with a first receiving space and a second receiving space respectively; the first receiving space and the second receiving space are in communication with each other and are configured for receiving the ballpoint/rollerball refill; and the rear barrel section has a rear end formed with a pen opening in communication with the second receiving space in order for the ballpoint/rollerball tip of the ballpoint/rollerball refill to be exposed from the rear end of the rear barrel section through the pen opening, and for the ink tube of the ballpoint/rollerball refill to pass sequentially through the second receiving space and the first receiving space into the compression force application groove.

7. The pen structure of claim 6, wherein the pen body further comprises an ink tube positioning member; the ink tube positioning member has a rear end connected to the front end of the connecting barrel section and has a front end extending into the compression force application groove; the ink tube positioning member is provided therein with an ink tube positioning space in which to position a portion of the ink tube that is away from the ballpoint/rollerball tip, thereby keeping the ink tube from falling off; the front end of the rear barrel section is movably connected to the rear end of the ink tube positioning member or the rear end of the connecting barrel section; the user, when desiring to write or draw with the ballpoint/rollerball tip, only has to turn the rear barrel section in a direction with fingers, and the rear barrel section will be displaced toward the connecting barrel section and thereby drive the ballpoint/rollerball tip of the ballpoint/rollerball refill out of the pen opening so that the ballpoint/rollerball tip is exposed from the rear end of the rear barrel section and ready for use in writing or drawing; and when the ballpoint/rollerball tip is not to be used, the user only has to turn the rear barrel section in an opposite direction with the fingers, and the rear barrel section will be displaced away from the connecting barrel section and thereby retract the ballpoint/rollerball tip of the ballpoint/rollerball refill into the pen opening so that the ballpoint/rollerball tip is stored and hidden in the second receiving space of the rear barrel section.

8. The pen structure of claim 5, further comprising at least one cover, wherein the cover has a closed first end and an opposite second end provided with a mounting opening, and the mounting opening is configured and sized to render the second end of the cover mountable around the rear end or the front end of the pen body, in order for the cover to cover the ballpoint/rollerball tip, which is exposed from the rear end of the pen body, or the smashing cone, which is normally exposed from the front end of the pen body.

9. The pen structure of claim 8, wherein the cover has an inner wall circumferentially and protrudingly provided with a packing ring or threaded connection ring adjacent to the mounting opening, and the packing ring or threaded connection ring corresponds to and is tightly engageable in or threadedly connectable with the engaging groove or threaded connection groove.

10. The pen structure of claim 9, wherein the cover has an outer periphery protrudingly provided with a clip adjacent to the closed first end of the cover so that the pen structure is able to be clipped to an outer edge of an opening of a pocket in or on the user's clothes.

11. A pen structure with a glass smasher, comprising:

a pen body having a front end formed with an aperture, wherein the pen body is provided therein, sequentially in a front-to-rear direction, with an impact groove and a compression force application groove; the aperture is in communication with the impact groove and the compression force application groove sequentially; the aperture has a smaller diameter than the impact groove and the compression force application groove;

the glass smasher, mounted at the front end of the pen body and comprising:

a smashing rod having a front section with a front end formed with a smashing cone;

a guide spring mounted around a periphery of the smashing rod at a position adjacent to a middle section and a rear section of the smashing rod, wherein the guide spring has a front end pressed against a portion of the smashing rod that is adjacent to the front section of the smashing rod, thereby forcing an axis of the smashing rod to be offset from an axis of the compression force application groove and pushing the smashing rod outward of the aperture such that the smashing cone of the front section of the smashing rod is driven through the aperture and exposed from the front end of the pen body;

a guide block movably positioned in the compression force application groove, wherein the guide block has a front-end wall able to be pressed at least against a rear end of the guide spring, the front-end wall of the guide block is concavely provided with a guide groove, the guide groove matches the middle section and the rear section of the smashing rod in diameter so that a rear end of the smashing rod is able to extend through the guide groove, and the front-end wall or a rear-end wall of the guide block forms a curved guide surface;

an offset striking block movably positioned in the compression force application groove, wherein the offset striking block has a front-end side pressed against the rear-end wall of the guide block and concavely provided with a striking groove corresponding to the guide groove such that, once extending through the guide groove, the rear end of the smashing rod is pressed against the front-end side of the offset striking block to prevent the rear section of the smashing rod from extending into the striking groove; and the front-end side or a rear-end side of the offset striking block also forms a curved guide surface; and a compression spring positioned in the compression force application groove, wherein the compression spring has a front end pressed against the rear-end side of the offset striking block and has a rear end pressed against a wall of the compression force application groove, in order to push the offset striking block toward the impact groove and apply a huge elastic force to the offset striking block, and while the compression spring is being compressed, the curved guide surfaces fine-tune the compression spring and the offset striking block in angle and position, in order for the striking groove in the offset striking block to correspond to the guide groove, and for the rear end of the smashing rod to extend into the striking groove immediately after passing through the guide groove; and a ballpoint/rollerball refill detachably provided in the pen body, wherein the ballpoint/rollerball refill has a ballpoint/rollerball tip and an ink tube, the ballpoint/rollerball tip is exposed from a rear end of the pen body, and the ink tube extends into the pen body in order for the ballpoint/rollerball refill to have a length of at least 6 cm and therefore be able to hold enough ink for use in writing or drawing for a long time, and for the pen body to have an overall length of at least 10 cm and therefore be able to be easily held by a user while the user writes or draws with the ballpoint/rollerball tip and while the user applies a force to a glass obstacle through the smashing cone at a front end of the smashing rod to smash the glass obstacle, wherein the ink tube of the ballpoint/rollerball refill extends into the compression force application groove and is positioned in a central portion of the compression spring to make effective use of unused space in the glass smasher.

12. The pen structure of claim 11, wherein the guide block has a front end able to be pressed against a wall portion of the compression force application groove that is adjacent to the impact groove.

13. The pen structure of claim 12, wherein the rear section of the smashing rod has a longitudinal length greater than a longitudinal depth of the striking groove.

14. The pen structure of claim 13, wherein the pen body has an outer periphery circumferentially and concavely provided with an engaging groove or threaded connection groove adjacent to at least one of the front end and the rear end of the pen body.

15. The pen structure of claim 14, wherein the pen body comprises a front barrel section, a middle barrel section, a connecting barrel section, and a rear barrel section sequentially connected together; the aperture is formed at a front end of the front barrel section; the impact groove is formed in the front barrel section at a position away from the aperture but is in communication with the aperture; the middle barrel section has a front end connected to a rear end of the front barrel section; the compression force application groove is formed in the middle barrel section; the connecting barrel section has a front end connected to a rear end of the middle barrel section and has a rear end connected to a front end of the rear barrel section; the connecting barrel section and the rear barrel section are provided therein with a first receiving space and a second receiving space respectively; the first receiving space and the second receiving space are in communication with each other and are configured for receiving the ballpoint/rollerball refill; and the rear barrel section has a rear end formed with a pen opening in communication with the second receiving space in order for the ballpoint/rollerball tip of the ballpoint/rollerball refill to be exposed from the rear end of the rear barrel section through the pen opening, and for the ink tube of the ballpoint/rollerball refill to pass sequentially through the second receiving space and the first receiving space into the compression force application groove.

16. The pen structure of claim 15, wherein the pen body further comprises an ink tube positioning member, the ink tube positioning member has a rear end connected to the front end of the connecting barrel section and has a front end extending into the compression force application groove, the ink tube positioning member is provided therein with an ink tube positioning space in which to position a portion of the ink tube that is away from the ballpoint/rollerball tip, thereby keeping the ink tube from falling off; the front end of the rear barrel section is movably connected to the rear end of the ink tube positioning member or the rear end of the connecting barrel section; the user, when desiring to write or draw with the ballpoint/rollerball tip, only has to turn the rear barrel section in a direction with fingers, and the rear barrel section will be displaced toward the connecting barrel section and thereby drive the ballpoint/rollerball tip of the ballpoint/rollerball refill out of the pen opening so that the ballpoint/rollerball tip is exposed from the rear end of the rear barrel section and ready for use in writing or drawing; and when the ballpoint/rollerball tip is not to be used, the user only has to turn the rear barrel section in an opposite direction with the fingers, and the rear barrel section will be displaced away from the connecting barrel section and thereby retract the ballpoint/rollerball tip of the ballpoint/rollerball refill into the pen opening so that the ballpoint/rollerball tip is stored and hidden in the second receiving space of the rear barrel section.

17. The pen structure of claim 14, further comprising at least one cover, wherein the cover has a closed first end and an opposite second end provided with a mounting opening, and the mounting opening is configured and sized to render the second end of the cover mountable around the rear end or the front end of the pen body, in order for the cover to cover the ballpoint/rollerball tip, which is exposed from the rear end of the pen body, or the smashing cone, which is normally exposed from the front end of the pen body.

18. The pen structure of claim 17, wherein the cover has an inner wall circumferentially and protrudingly provided with a packing ring or threaded connection ring adjacent to the mounting opening, and the packing ring or threaded connection ring corresponds to and is tightly engageable in or threadedly connectable with the engaging groove or threaded connection groove.

19. The pen structure of claim 18, wherein the cover has an outer periphery protrudingly provided with a clip adjacent to the closed first end of the cover so that the pen structure is able to be clipped to an outer edge of an opening of a pocket in or on the user's clothes.

* * * * *